United States Patent [19]

Watson et al.

[11] 4,047,980

[45] Sept. 13, 1977

[54] PROCESSING CHROMIUM-CONTAINING PRECIPITATION HARDENABLE COPPER BASE ALLOYS

[75] Inventors: W. Gary Watson, Cheshire; John F. Breedis, Trumbull, both of Conn.

[73] Assignee: Olin Corporation, New Haven, Conn.

[21] Appl. No.: 728,976

[22] Filed: Oct. 4, 1976

[51] Int. Cl.[2] ..... C22F 1/08

[52] U.S. Cl. ..... 148/12.7 C

[58] Field of Search ..... 75/153; 148/12.7 C, 148/32.5, 160

[56] References Cited

U.S. PATENT DOCUMENTS

| | | | |
|---|---|---|---|
| 2,281,691 | 5/1942 | Hensel et al. | 148/160 |
| 3,143,442 | 8/1964 | Watts | 148/32.5 |
| 3,194,655 | 7/1965 | Pels et al. | 75/153 |
| 3,357,824 | 12/1967 | Saarvita | 75/153 |
| 3,421,888 | 1/1969 | Saarvita | 75/153 |
| 3,717,511 | 2/1973 | Wallbaum | 148/12.7 C |
| 3,881,965 | 5/1975 | Matsuda et al. | 148/12.7 C |
| 3,969,156 | 7/1976 | Wallbaum | 148/12.7 C |

*Primary Examiner*—W. Stallard

*Attorney, Agent, or Firm*—Robert A. Dawson; Robert H. Bachman

[57] ABSTRACT

A process of heat treating and mechanically working chromium-containing precipitation hardenable copper base alloys is disclosed. The combination of hot and cold working, annealing and novel low temperature thermal treatment steps increases both the strength and electrical conductivity properties of the alloys without excessive cold working.

16 Claims, No Drawings

PROCESSING CHROMIUM-CONTAINING PRECIPITATION HARDENABLE COPPER BASE ALLOYS

BACKGROUND OF THE INVENTION

Commercially useful copper base alloys which possess a combination of high strength and high electrical conductivity are usually difficult to obtain because the methods and elements utilized to provide good strength properties, for example, usually do so at the detriment of the electrical conductivity of the alloys. From a number of approaches to the solution of this problem, two methods of achieving the combination of high strength and high electrical conductivity have been most readily utilized. The first method is determining and adjusting the elements to be alloyed with the base copper to provide inherent high strength and electrical conductivity properties in the resulting alloy system. Elements such as zirconium and chromium have been used in the past as additions to copper base alloys to provide the desirable strength-conductivity combination. Precipitation hardened alloys which contain chromium generally have lower electrical conductivity but higher strength than pure copper. The precipitation of zirconium in copper is known to give large increases in electrical conductivity to the base copper but only small increases in strength properties over the values for the solid solution of zirconium in copper.

Another method which has been utilized to provide the strength-conductivity combination in copper base alloys includes adjusting the homogenization, hot working, annealing and aging of the alloy to provide high strength properties to the alloy system without reducing the electrical conductivity of the system. An example of this approach may be found in U.S. Pat. No. 3,930,894, issued Jan. 6, 1976. This patent teaches a method of working phosphor-bronze copper alloys which includes a high temperature homogenization, hot and cold working, intermediate annealing and a final heat treatment to provide desired properties. The alloy system utilized in said patent may include chromium. This patent does not discuss treating precipitation hardenable copper base alloys which contain chromium as an alloying element.

The present invention is an attempt to overcome the shortcomings of the alloying element methods and processing method described above by treating chromium-containing precipitation hardenable copper base alloys so that not only the strength properties of said alloys are increased after treatment but the electrical conductivity properties are also increased.

Accordingly, it is a principal object of the present invention to provide a method of processing chromium-containing precipitation hardenable copper base alloys in such a manner so as to increase both the strength and electrical conductivity properties of the alloys.

Further objects and advantages of the present invention will become apparent from a consideration of the following specification.

SUMMARY OF THE INVENTION

In accordance with the present invention it has been found that the foregoing object may be readily achieved by processing a precipitation hardenable chromium-containing copper base alloy according to the following steps:

a. casting a precipitation hardenable copper base alloy which contains chromium;

$b_1$. hot working the alloy at a starting temperature of 850°-950° C; or $b_2$. hot working the alloy at a starting temperature of 950°-1000° C to effect the maximum solid solution of all alloying elements;

c. if step ($b_1$) has been utilized, solution annealing the worked alloy at a solutionizing temperature of 950°-1000° C, preferably 975°-1000° C, for a period of time sufficient to insure the maximum solid solution of all alloying elements;

d. rapidly cooling said alloy to maintain said maximum solid solution to all alloying elements;

e. cold working the alloy to a total reduction of at least 60% and preferably to at least 75%;

f. aging said alloy at 400°-500° C for one to 24 hours and preferably 430°-470° C for 2 to 10 hours;

g. cold working the alloy to a total reduction of at least 50% and preferably to at least 75%;

h. aging said alloy at 150°-250° C for one to 24 hours and preferably 175°-225° C for 2 to 10 hours; and i. optionally cold working said alloy to the final desired temper.

DETAILED DESCRIPTION

The present invention provides an improvement in the combination of strength and electrical conductivity properties of the alloy system being processed through the steps of solution annealing to bring all alloying elements into maximum solid solution, cold working the alloy to such a degree so as to strain harden the alloy to high strength and finally subjecting the alloy to an aging/cold working combination of steps.

The alloy system which may be processed effectively according to the present invention must be precipitation hardenable and should contain at least a small percentage of chromium. Additional alloying elements may be added to the copper-chromium system, among which are zirconium, vanadium and niobium. Other elements may also be added to achieve particularly desirable strength and/or conductivity properties.

The hot working step of the processing of the present invention may by itself be used to provide the effect of solution annealing. This is generally accomplished by performing the hot working at a temperature which is high enough to place all of the alloying elements into maximum solid solution. This temperature should be at least 950° C with a preferred temperature range of 975°-1000° C to insure said maximum solid solution.

The alloys utilized in said process are generally cast at a temperature which ranges between 25° C above the melting point of the alloy up to approximately 1300° C. This casting may be performed by any known and convenient method.

The hot working reduction requirement is generally what is most convenient for further working. The process utilized in the present invention has no particular dimensional requirements other than that the hot working be accomplished according to good mill practice. If the hot working step is also utilized to provide the solution annealing of the alloy, the main consideration is that the hot working be performed to effect the maximum solid solution of all the alloying elements. This permits the later precipitation during aging of the most desirable high volume fraction of fine uniform dispersions of intermediate solid phases consisting of chromium, zirconium and niobium, the phases existing in the alloy matrix either as dependent or intermixed phases. The solution annealing step of the process utilized in the present invention, whether performed as part of the hot working step or as a separate step after hot working, also provides for the maximum solid solution of all the alloying elements. This solution annealing is accomplished at a temperature between 950° and 1000° C. It is preferred that the solution annealing be accomplished at a temperature between 975° and 1000° C. It should be noted that this solution annealing step can take place at any point in the instant process after the initial hot working step, provided that rapid cooling, cold working and aging steps are performed after the solution annealing step.

The alloy, after being either hot worked alone or hot worked in combination with a separate solution annealing step, is then rapidly cooled so as to maintain the maximum solid solution of all alloying elements. Cooling to 350° C or less is necessary to maintain said maximum solid solution. This cooling may be accomplished according to procedures well known in this art, using either air or a liquid as the cooling medium.

The next step in the process utilized in the present invention is cold working of the alloy. This cold working step is utilized to provide an increase in strength to the alloy as well as being used to meet dimensional requirements. The alloy is generally cold worked to an initial reduction of at least 60% and preferably at least 75%. This relatively high cold reduction serves to impart more strain hardening to the alloy prior to aging as well as impart improvement in the electrical conductivity of the aged alloy. The improvement in electrical conductivity after aging of the alloy is presumably brought about by altering the kinetics of precipitation in the alloy matrix. This cold working step may be the final cold working before aging of the alloy if the alloy is reduced to the final desired dimensions. The cold working may be utilized in cycles with the aging so that a cycle may end with either an aging step or a cold working step.

The cold working of the alloy is followed by an aging step. This aging is generally performed at a temperature between 400°-500° C for one to 24 hours, preferably between 430°-470° C for 2 to 10 hours. This aging is performed to increase the mechanical and electrical conductivity properties of the alloy. After this aging step, the alloy is further cold worked to a total reduction of at least 50% and preferably 75%. The alloy is then aged at a temperature between 150°-250° C for one to 24 hours, preferably between 175°-225° for 2 to 10 hours. This final aging is performed to restore the electrical conductivity values to the highly cold worked alloy and thus provide the desirable combination of high electrical conductivity and high strength in the alloy.

The process of the present invention also contemplates the steps of fabricating a final desired article out of the worked alloy material and then subjecting said fabricated article to the low temperature thermal treatment of the present invention. In other words, the final cold working step before the final low temperature thermal treatment step of the present invention will become a fabricating cold working step.

The process of the present invention and the advantages obtained thereby may be more readily understood from a consideration of the following illustrative example.

EXAMPLE

An alloy having a composition of 0.60% by weight chromium, 0.16% by weight zirconium, 0.18% by weight niobium, balance essentially copper was vacuum melted and cast under an argon protective atmosphere. After hot working the alloy, it was solution annealed at 1000° C for 45 minutes to place all alloying elements into maximum solid solution. The alloy was then cooled and subjected to cold working with a 75% reduction. The alloy was subjected to heat treatment of 450° C for 4 hours and was then cold worked to an additional 75% reduction. Properties of the alloy were measured at this point in the processing and again after an additional heat treatment at 200° C for 8 hours. Both the strength and electrical conductivity properties of the alloy increased after the additional low temperature heat treatment. These results are shown in Table I. For a comparison, this processing was compared to another processing system from the literature. This other system contained an alloy composed of copper with 0.40% by weight chromium, 0.15% by weight zirconium, 0.05% by weight magnesium, balance essentially copper. This alloy was subjected to the processing shown in Table I and measurements of its properties were taken both after cold reduction and after an additional heat treatment.

TABLE I

ELECTRICAL CONDUCTIVITY AND STRENGTH COMPARISON PROPERTIES

| Processing | UTS (ksi) | 0.2% YS (ksi) | % IACS |
|---|---|---|---|
| S.A. + 75% CR + 450° C/4 hrs. + 75% CR (A) | 92 | 88 | 71 |
| (A) + 200° C/8 hrs. | 98 | 93 | 74 |
| Literature Processing[1] | | | |
| S.A. + 60% RA + 450° C/½ hr. + 90% RA (A) | 100 | 97 | 65 |
| (A) + 450° C/½ hr. | 95 | 90 | 80 |

[1] P. W. Taubenblatt et al., Metals Engineering Quarterly, November 1972, Volume 12, p. 41.

Table I illustrates the improvement in both strength and electrical conductivity obtained by the final low temperature thermal treatment in the process of the present invention. This improvement in both strength and conductivity properties is to be contrasted with the properties obtained from the high temperature thermal treatment from the literature processing, where the strength properties were diminished with treatment and only the electrical conductivity was improved. The process of the present invention therefore presents an opportunity to improve both the strength and electrical conductivity properties of an alloy without detrimentally affecting either one of the properties.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for improving both the strength and electrical conductivity properties of copper base alloys, which comprises:

a. casting a chromium-containing precipitation hardenable copper base alloy;

b. hot working the alloy at a starting temperature of 950°-1000° C to effect the maximum solid solution of all alloying elements;

c. rapidly cooling the alloy to maintain said maximum solid solution of all alloying elements;

d. cold working the alloy to a total reduction of at least 60%;

e. aging said alloy at 400°-500° C for one to 24 hours;

f. cold working the alloy to a further total reduction of at least 50%; and g. aging said alloy at 150°-250° C for 1 to 24 hours.

2. A process for improving both the strength and electrical conductivity properties of copper base alloys, which comprises:

a. casting a chromium-containing precipitation hardenable copper base alloy;

b. hot working the alloy at a starting temperature of 850°-950° C;

c. solution annealing the worked alloy at a solutionizing temperature of 950°-1000° C, for a period of time sufficient to insure the maximum solid solution of all alloying elements;

d. rapidly cooling the alloy to maintain said maximum solid solution of all alloying elements;

e. cold working the alloy to a total reduction of at least 60%;

f. aging said alloy at 400°-500° C for one to 24 hours;

g. cold working the alloy to a further total reduction of at least 50%; and h. aging said alloy at 150°-250° C for one to 24 hours.

3. A process as in claim 1 wherein said aging of step (e) is accomplished in cycles with said cold working of step (d), where the cycles end with either an aging or a cold working step.

4. A process as in claim 2 wherein said aging of step (a) is accomplished in cycles with said cold working of step (g).

5. A process as in claim 1 wherein the alloy is cast at a temperature which ranges between 25° C above the melting point of the alloy up to 1300° C.

6. A process as in claim 1 wherein said rapid cooling is sufficient to cool the alloy to at least 350° C.

7. A process as claim 1 wherein the hot working occurs at a temperature of 975°-1000° C.

8. A process as in claim 2 wherein the alloy is cast at a temperature which ranges between 25° C above the melting point of the alloy up to 1300° C.

9. A process as in claim 2 wherein said rapid cooling is sufficient to cool the alloy to at least 350° C.

10. A process as in claim 2 wherein the solutionizing temperature is 975°-1000° C.

11. A process as in claim 1 wherein said aging in step (e) is at 430°-470° C for 2 to 10 hours.

12. A process as in claim 1 wherein said aging in step (g) is at 175°-225° C for 2 to 10 hours.

13. A process as in claim 2 wherein said aging in step (f) is at 430°-470° C for 2 to 10 hours.

14. A process as in claim 2 wherein said aging in step (h) is at 175°-225° C for 2 to 10 hours.

15. A process as in claim 1 wherein said process includes the step of fabricating a wrought article from the worked alloy before subjecting said alloy to the aging of step (g).

16. A process as in claim 2 wherein said process includes the step of fabricating a wrought article from the worked alloy before subjecting said alloy to the aging of step (h).

* * * * *

UNITED STATES PATENT AND TRADEMARK OFFICE

Certificate

Patent No. 4,047,980 Patented September 13, 1977

W. Gary Watson and John F. Breedis

Application having been made by W. Gary Watson and John F. Breedis, the inventors named in the patent above identified, and Olin Corporation, a corporation of Virginia, the assignee, for the issuance of a certificate under the provisions of Title 35, Section 256, of the United States Code, adding the names of Brian Mravic and Stanley Shapiro as joint inventors, and a showing and proof of facts satisfying the requirements of the said section having been submitted, it is this 20th day of June 1978, certified that the names of the said Brian Mravic and Stanley Shapiro are hereby added to the said patent as joint inventors with the said W. Gary Watson and John F. Breedis.

FRED W. SHERLING,

*Associate Solicitor.*